United States Patent [19]

Nakajima et al.

[11] Patent Number: 5,020,976

[45] Date of Patent: Jun. 4, 1991

[54] VARIALE CAPACITY VANE COMPRESSOR

[75] Inventors: Nobuyuki Nakajima; Toshio Yamaguchi; Yuji Kawashima, all of Konan, Japan

[73] Assignee: Diesel Kiki Co., Ltd., Tokyo, Japan

[21] Appl. No.: 525,846

[22] Filed: May 21, 1990

[30] Foreign Application Priority Data

May 26, 1989 [JP] Japan ..... 1-133673
Jun. 23, 1989 [JP] Japan ..... 1-161145

[51] Int. Cl.[5] ..... F04B 49/00
[52] U.S. Cl. ..... 417/295; 417/310
[58] Field of Search ..... 417/295, 310

[56] References Cited

U.S. PATENT DOCUMENTS 4,929,156 5/1990 Eitai ..... 417/295

FOREIGN PATENT DOCUMENTS 141391 9/1989 Japan .

*Primary Examiner*—Robert G. Nilson
*Attorney, Agent, or Firm*—Charles S. McGuire

[57] ABSTRACT

A variable capacity vane compressor has a cylinder including a plurality of vanes slidably fitted in respective vane slits formed in a rotor thereof. Vane back pressure chambers are defined within the vane slits by respective ones of the vanes. A control element is rotatably arranged in the cylinder for varying the compression starting timing and hence the capacity of the compressor. Back pressure compensation holes are formed through the control element and communicating with a high pressure zone having high pressure of the compressor. The back pressure compensation holes are communicatable with each of the vane back pressure chambers for introducing the high pressure within the high pressure zone into the each vane back pressure chamber when the control element is in a first position wherein the compression starting timing is most retarded. The back pressure compensation holes are disconnectable from the each vane back pressure chamber for inhibiting the high pressure within the high pressure zone from being introduced into the each vane back pressure chamber when the control element is in a second position wherein the compression starting timing is most advanced.

6 Claims, 12 Drawing Sheets

VARIALE CAPACITY VANE COMPRESSOR

BACKGROUND OF THE INVENTION

This invention relates to a variable capacity vane compressor which is adapted to vary the compression starting timing for varying the capacity thereof, and more particularly to a vane compressor of this kind which is free from chattering of the vanes and at the same time excessive wear in the tips of the vanes.

In order to prevent chattering of vanes due to insufficient vane back pressure acting thereon and at the same time avoid wear in the tips of the vanes due to excessive vane back pressure, a variable capacity vane compressor has conventionally been proposed e.g. by Japanese Provisional Utility Model Publication (kokai) No. 1-141391 assigned to the applicant of the present application, which has a central annular groove formed in one end face of one side block facing a rotor and communicatable with each of vane back pressure chambers formed in the rotor to introduce pressure created from discharge pressure Pd therethrough into the each vane back pressure chamber while the associated vane is moving from a suction stroke-starting position to an intermediate position during the compression stroke. Oil supply holes are formed in the same side block and communicatable with each vane back pressure chamber to introduce oil under pressure created from discharge pressure Pd, which is higher than the pressure from the annular groove, into the each vane back pressure chamber for preventing a decrease in the vane back pressure Pk after the vane back pressure chamber is brought out of communication with the annular groove and until the delivery stroke is completed.

According to the proposed compressor, the oil is introduced from the oil supply holes into the vane back pressure chamber under the same pressure irrespective of whether the compressor is in partial capacity operation or in full capacity operation, after the vane back pressure chamber are brought out of communication with the annular groove and before completion of the discharge stroke.

However, in a vane compressor like the proposed compressor, as shown in FIG. 8, when the compressor is brought into partial capacity operation wherein the discharge pressure Pd is low so that the capacity assumes the minimum value, the vane back pressure Pk largely drops, resulting in chattering of the vanes. The reason for the large drop in the vane back pressure Pk is as follows: Another side block which is located on the opposite side of the rotor to the one side block is always acted upon by suction pressure Ps at an end face thereof remote from the rotor. Therefore, when the compressor is in partial capacity operation where the discharge pressure Pd is low, the rotor is urged by the other side block and biased toward the one side block. Accordingly, the clearance between the one side block and the rotor becomes smaller so that the oil is introduced in reduced amounts from the oil supply holes into the vane back pressure chambers, resulting in a large drop in the vane back pressure Pk.

One way to prevent such a large drop in the vane back pressure Pk would be to enlarge the opening area of the oil supply holes so as to increase the amount of oil to be supplied therethrough. However, according to this method, once the rotor is biased toward the one side block, the actual amount of oil cannot increase to a desired degree even with the enlarged oil supply holes.

Further, if the opening area of the oil supply holes is enlarged, when the rotor is biased toward the other side block, the vane back pressure Pk will become excessively high, resulting in wear in the tips of the vanes as well as increased power required for driving the compressor.

SUMMARY OF THE INVENTION

It is the object of the invention to provide a variable capacity vane compressor which is capable of maintaining the vane back pressure at a proper level for preventing chattering of the vanes during partial capacity operation, while avoiding wear in the tips of the vanes during full capacity operation.

To achieve the above object, the present invention provides a variable capacity vane compressor including a cylinder, a rotor rotatably received within the cylinder, a plurality of vanes slidably fitted in respective vane slits formed in the rotor, vane back pressure chambers defined within the vane slits by respective ones of the vanes, a high pressure zone having high pressure created therein by the compressor, a control element rotatably arranged in the cylinder for varying the compression starting timing and hence the capacity of the compressor.

The variable capacity vane compressor according to the present invention is characterized by an improvement comprising back pressure compensation hole means formed through the control element and communicating with the high pressure zone, the back pressure compensation hole means being communicatable with each of the vane back pressure chambers for introducing the high pressure within the high pressure zone into the each vane back pressure chamber when the control element is in a first position wherein the compression starting timing is retarded, and disconnectable from the each vane back pressure chamber for inhibiting the high pressure within the high pressure zone from being introduced into the each vane back pressure chamber when the control element is in a second position wherein the compression starting timing is advanced.

Preferably, the back pressure compensation hole means has one end thereof opening in one end face of the control element facing the rotor, the one end of the back pressure compensation hole means being disposed to be in a radially inward position relative to the vanes to communicate with the vane back pressure chambers when the control element is in the first position, and in a radially outward position relative to the vanes to be disconnected from the vane back pressure chambers when the control element is in the second position.

More preferably, the back pressure compensation hole means comprises a passage formed in the cylinder and communicating with the high pressure zone, and a hole formed in the control element and communicating with the vane back pressure chambers, the hole being disposed to communicate with the passage when the control element is in the first position, and disconnected from the passage when the control element is in the second position.

The passage may comprise a restriction passage.

The compressor may include first and second side blocks forming part of the cylinder, and an annular groove formed in one end face of the first side block facing the rotor, the annular groove having at least one enlarged portion for communication with each of the vane back pressure chambers for introducing high pressure into the vane back pressure chamber while an associated one of the vanes is moving from a suction stroke-starting position to an intermediate position during a compression stroke thereof, the vane back pressure compensation hole means being arranged in the second side block.

The compressor may further include at least one oil supply hole formed in the first side block and having one end thereof opening in the one end face of the first side block at a location other than the annular groove for introducing high pressure into the each vane back pressure chamber after the enlarged portion of the annular groove is disconnected from the each vane back pressure chamber and until the associated one of the vanes completes a delivery stroke thereof.

The above and other objects, features and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
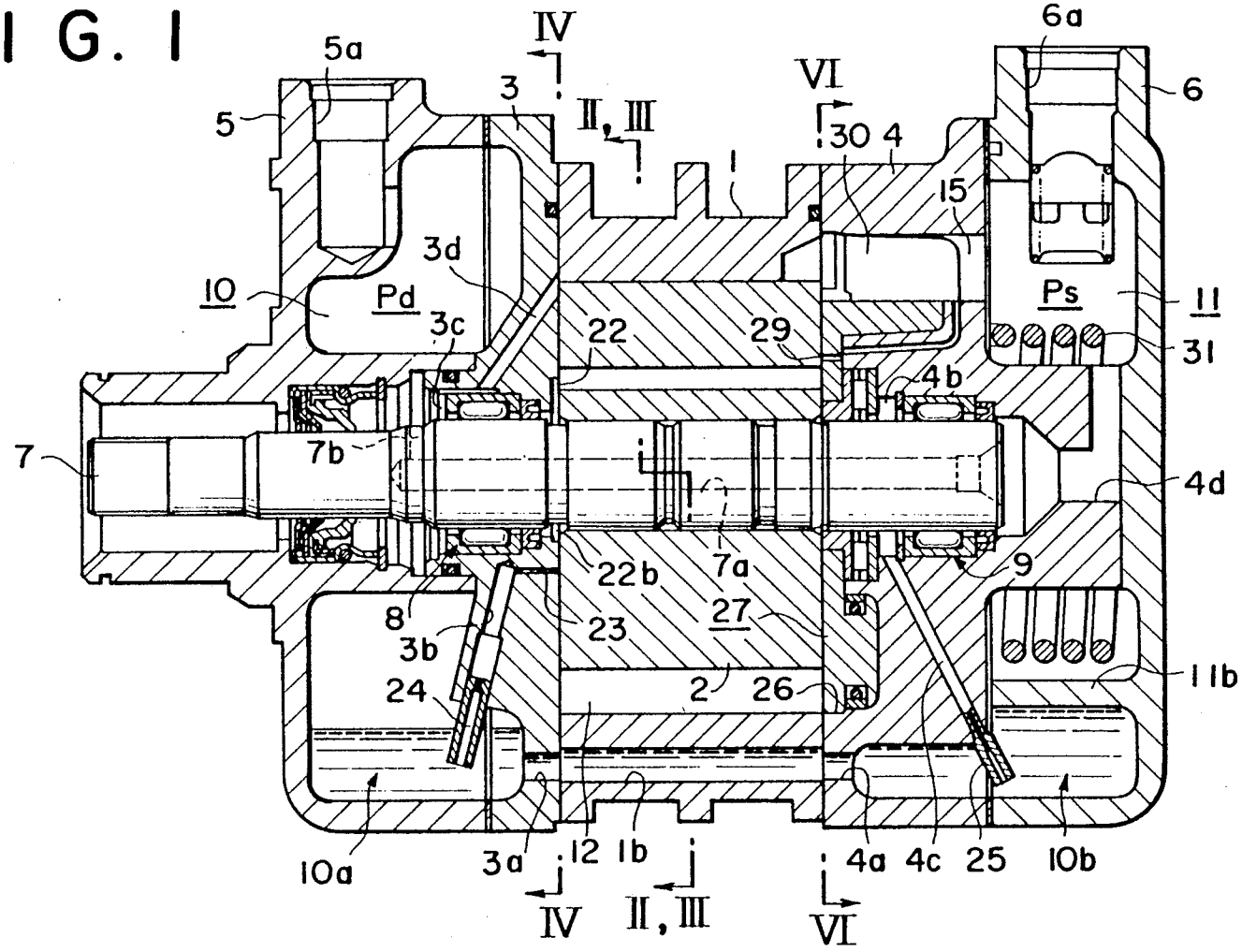
FIG. 1 is a longitudinal cross-sectional view of a variable capacity vane compressor, according to a first embodiment of the invention.
Figure 2:
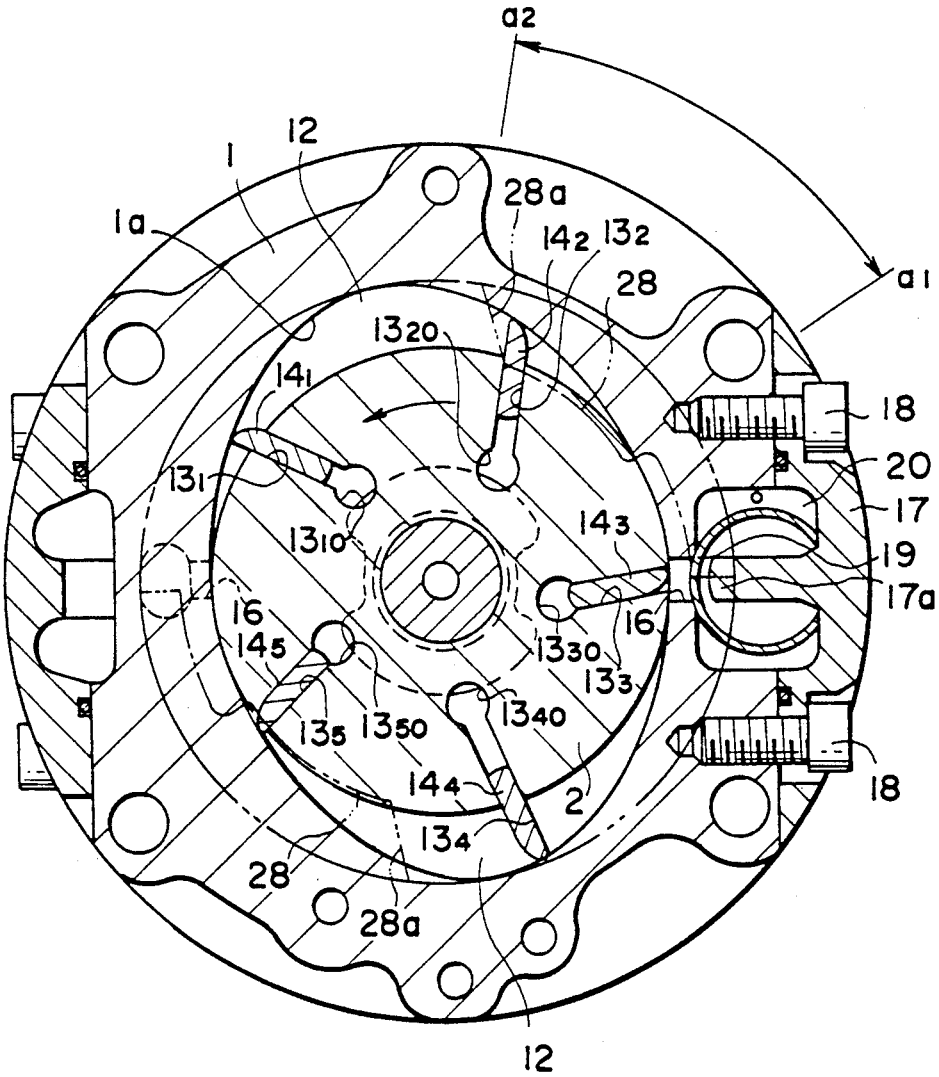
FIG. 2 is a transverse cross-sectional view taken along line II—II in FIG. 1, wherein the compressor is in full capacity operation.

Referring first to FIGS. 1 through 7, there is illustrated a variable capacity vane compressor according to a first embodiment of the invention. As shown in FIGS. 1 and 2, the compressor has a cylinder formed by a cam ring 1 having an inner peripheral camming surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As shown in FIG. 2, a pair of compression spaces 12, 12 are defined at diametrically opposite locations between the inner peripheral camming surface 1*a* of the cam ring 1, an outer peripheral surface of the rotor 2, an end face of the front side block 3 on the cam ring 1 side, and an end face of a control element 27 on the cam ring 1 side.

The rotor 2 has its outer peripheral surface formed therein with a plurality of (five in the illustrated embodiment) axial vane slits $13_1$–$13_5$ at circumferentially equal intervals, in each of which a vane $14_1$–$14_5$ is radially slidably fitted.

A pair of refrigerant inlet ports 15, 15 are formed in the rear side block 4 at diametrically opposite locations, only one of which is shown in FIG. 1. These refrigerant inlet ports 15, 15 axially extend through the rear side block 4 and through which the suction chamber 11 is communicated with the compression spaces 12, 12.

Figure 4:
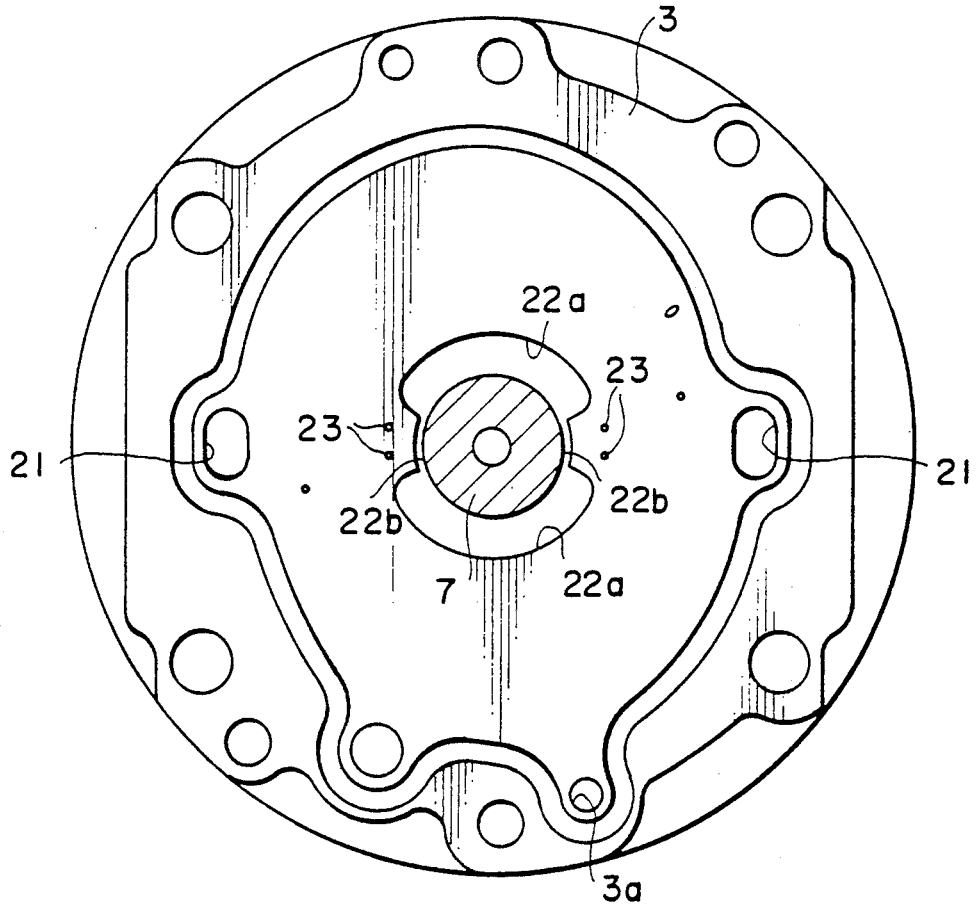
FIG. 4 is an end view of a front side block as viewed from the arrow IV—IV in FIG. 1.

A pair of refrigerant outlet ports 16, 16 are formed through opposite lateral side walls of the cam ring 1 at diametrically opposite locations, as shown in FIGS. 2, only one of which is shown in FIG. 2. The opposite lateral side walls of the cam ring 1 are provided with two discharge valve covers 17, 17, each formed integrally with a valve stopper 17*a*, and fixed to the cam ring 1 by fixing bolts 18. Discharge valves 19, 19 are mounted between the respective lateral side walls of the cam ring 1 and the valve covers 17, 17 in such a manner that they are supported by the valve covers 17, 17. A pair of communication passages 20, 20, one of which is shown in FIG. 2, are defined between the respective lateral side walls of the cam ring 1 and the valve covers 17, 17, which communicate with the respective refrigerant outlet ports 16 when the associated discharge valves 19 are open. A pair of communication passages 21, 21, one of which is shown in FIG. 4, are formed in the front side block 3, which communicate with the respective communication passages 20.

With such arrangement, when the discharge valves 19 open to thereby open the refrigerant outlet ports 16, a compressed refrigerant gas in the associated compression spaces 12 is discharged through the refrigerant discharge outlet ports 16, the communication passages 20, 21 and the discharge pressure chamber 10, in the mentioned order, to be discharged into a refrigerating circuit, not shown, through the discharge port 5*a*.

Figure 5:
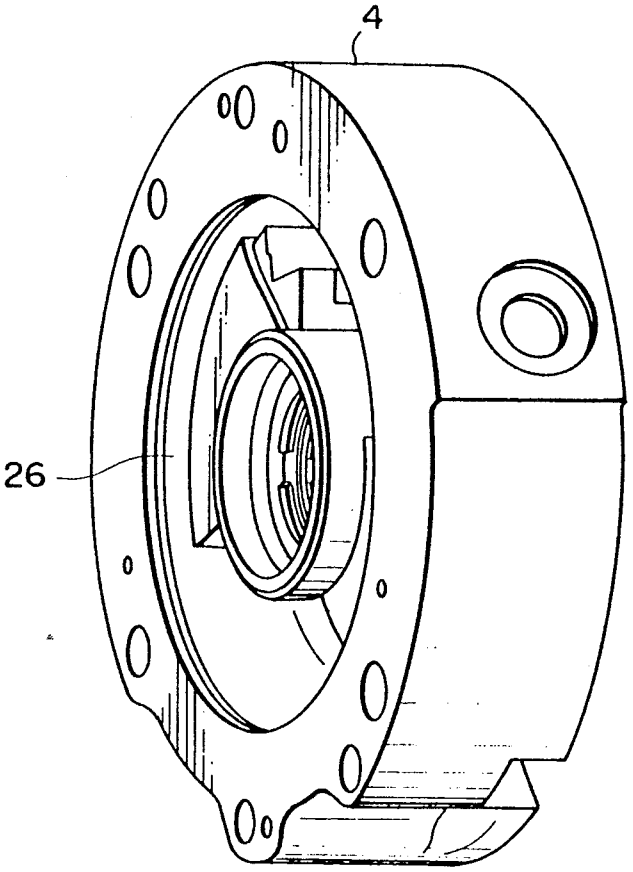
FIG. 5 is an exploded perspective view of a rear side block and a control element arranged therein.
Figure 5:
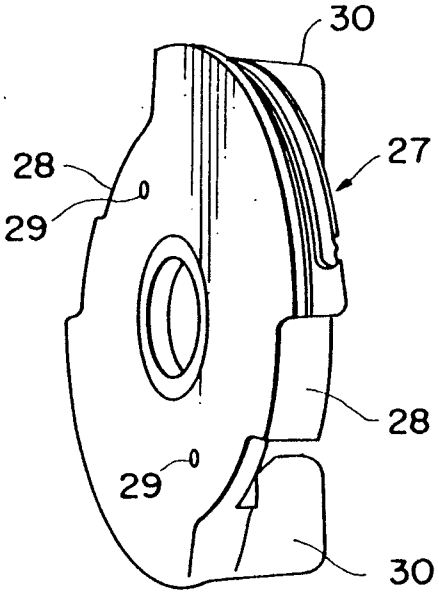
Figure 6:
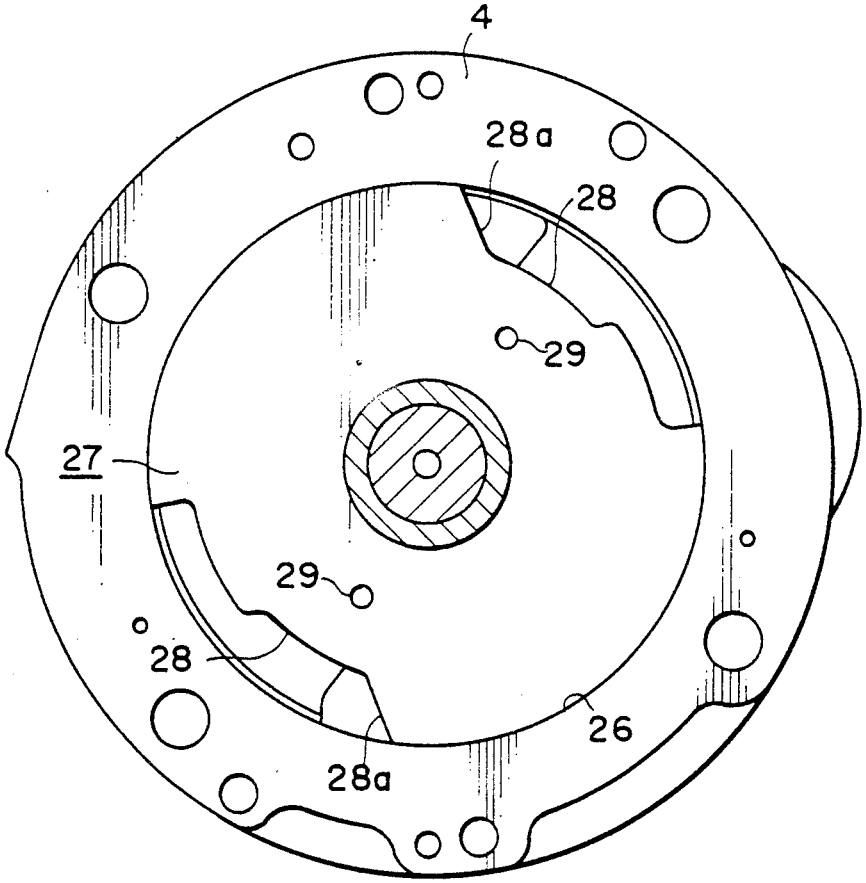
FIG. 6 is a transverse cross-sectional view taken along line VI—VI in FIG. 1.

As shown in FIGS. 1 and 5, the rear side block 4 has an end face facing the rotor 2, in which is formed an annular recess 26. A control element 27, which is in the form of an annulus, is received in the annular recess 26 for rotation about its own axis in opposite circumferential directions. The control element 27 has its outer peripheral edge formed with two diametrically opposite arcuate cut-outs 28, 28, and its one side surface formed integrally with a pair of diametrically opposite pressure-receiving protuberances 30, 30, which are axially projected therefrom and act as pressure-receiving elements. The pressure-receiving portions 30, 30 are slidably received in respective pressure working chambers, not shown, formed in a bottom of the annular recess 26 at diametrically opposite locations so that the interior space of each of the pressure working chambers is divided into two chambers, i.e. a higher pressure chamber and a lower pressure chambers, neither shown. Each of the pressure-receiving protuberances 30 has opposite side surfaces, one of which is acted upon by suction pressure Ps (low pressure) within the lower pressure chamber, whereas the other side surface is acted upon by control pressure Pc (high pressure) within the higher pressure chamber, which is created from the discharge pressure Pd supplied from the compression space 12 through a restriction passage, not shown, and the suction pressure Ps from the suction chamber 11. The control pressure Pc is controlled by a control valve device, not shown, such as one 32 in FIG. 9, which varies the control pressure Pc by diluting same with the suction pressure Ps such that the suction pressure Ps is brought to a predetermined value.

Figure 3:
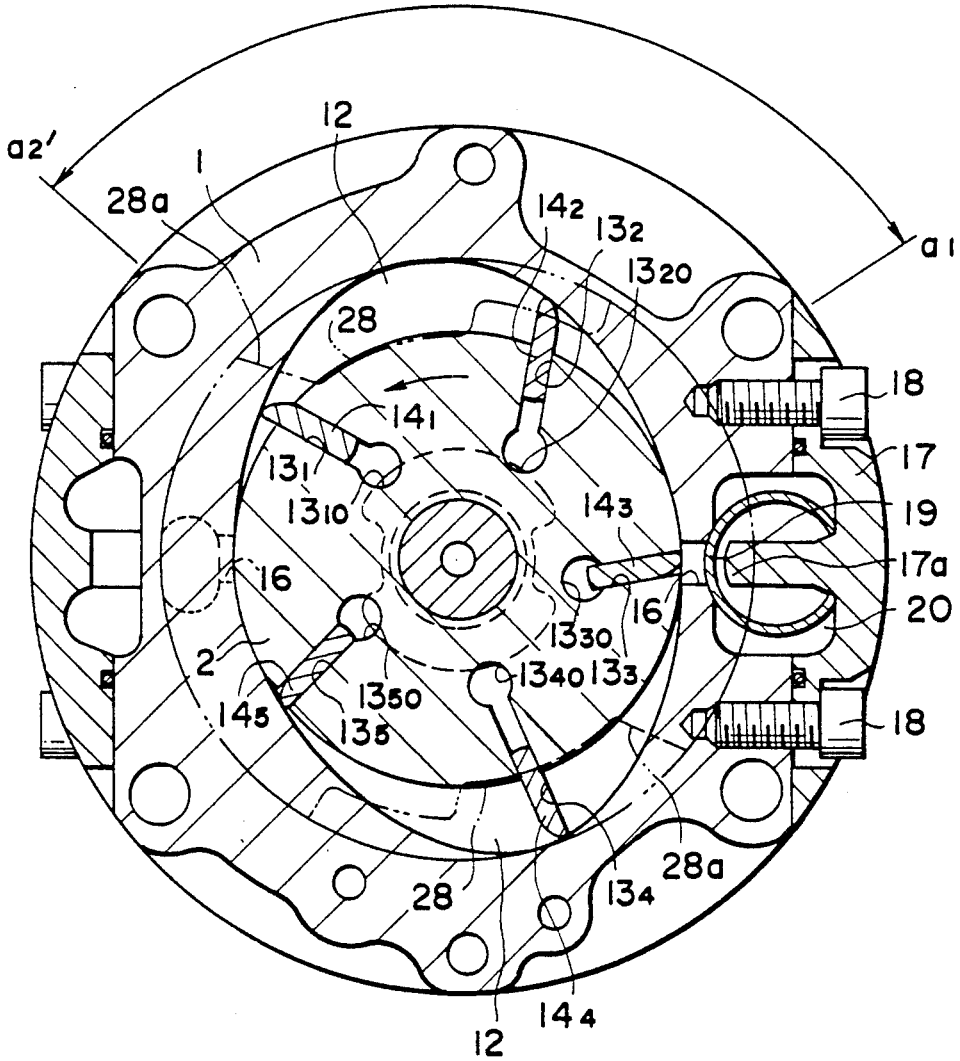
FIG. 3 is a view similar to FIG. 2, wherein the compressor is in partial capacity operation.

The control element 27 is urged in a counterclockwise direction, as viewed in FIGS. 2 and 3, by a torsion coiled spring 31, which, as shown in FIG. 1, is fitted around a hub of the rear side block 4 axially extending through the suction chamber 11 with its one end engaged with one side surface of the control element 27 remote from the rotor 2 and its other end engaged with an end face of the hub. Thus, the control element 27 is rotatable in opposite directions in response to the difference between the sum of the suction pressure Ps and the urging force of the torsion coiled spring 31, and the control pressure Pc, between two extreme positions, i.e. a full capacity position shown in FIG. 2 wherein the compression starting timing is advanced to the earliest timing for obtaining the maximum delivery quantity or capacity of the compressor, and a partial capacity position shown in FIG. 3 wherein the compression starting timing is retarded to the latest timing for obtaining the minimum delivery quantity or capacity.

As shown in FIG. 1, a front oil sump 10*a* is formed in the discharge pressure chamber 10 at a bottom thereof, whereas a rear oil sump 10*b* is formed in the rear head 6 at a location under the suction chamber 11 and isolated from the latter by a partition wall 11*b* formed integrally with the rear head 6. The front oil sump 10*a* and the rear oil sump 10*b* communicate with each other by way of communication passages 3*a*, 1*b*, 4*a* formed, respectively, through the front side block 3, the cam ring 1, and the rear side block 4 at their lower portions.

As shown in FIGS. 1 and 4, the front side block 3 has one end face facing the rotor 2 in which is formed an annular groove 22 extending around the driving shaft 7. The annular groove 22 is registrable with each of vane back pressure chambers $\mathbf{13}_{10}$–$\mathbf{13}_{50}$ defined by the respective vanes $\mathbf{14}_1$–$\mathbf{14}_5$ within the vane slits $\mathbf{13}_1$–$\mathbf{13}_5$. The annular groove 22 has a pair of enlarged portions 22*a*, 22*a* at diametrically opposite locations, and also a pair of narrowed portions 22*b*, 22*b* interposed between the enlarged portions 22*a*, 22*a* at diametrically opposite locations. The enlarged portions 22*a*, 22*a* correspond in circumferential location to the respective compression spaces 12, 12, so that they each communicate with the each back pressure chamber $\mathbf{13}_{10}$–$\mathbf{13}_{50}$ while the vane is moving from a suction stroke-starting point to an intermediate position during the compression stroke. The annular groove 22 is supplied with a discharged gas under medium pressure between the discharge pressure Pd and the suction pressure Ps, from the compression spaces 12, 12 through clearances between the opposed end faces of the front side block 3 and the rotor 2. Then, the discharge gas under the medium pressure is supplied from the annular groove 22 into the vane back pressure chambers $\mathbf{13}_{10}$–$\mathbf{13}_{50}$ as vane back pressure Pk.

Two pairs of oil supply holes 23 are formed in the front side block 3 at circumferentially opposite locations, one pair of which each have one end thereof opening in the one end face of the rotor 2 at a location radially outward of one of the narrowed portions 34*b*, 34*b*, and the other pair each one end thereof opening in the one end face of the rotor 2 at a location radially outward of the other narrowed portion 34*b*. The other ends of the oil supply holes 23 communicate with the front oil sump 10*a* of the discharge pressure chamber 10 through an oil passage 3*b* formed in the front side block 3, and a restriction passage 24. Thus, the oil supply holes 23 communicate with each of the vane back pressure chambers $\mathbf{13}_{10}$–$\mathbf{13}_{50}$ after the vane back pressure chamber $\mathbf{13}_{10}$–$\mathbf{13}_5$ is brought out of communication with the annular groove 22 and until the delivery stroke is completed. The vane back pressure chambers $\mathbf{13}_{10}$–$\mathbf{13}_{50}$ are supplied with oil from the oil supply holes 23 which has a pressure slightly lower than the discharge pressure Pd but higher than the medium pressure from the annular groove 22.

A front bearing chamber 3*c* is formed in the front side block 3 and accommodates the front bearing 8. The front bearing chamber 3*c* communicates with the suction chamber 11 through a radial hole 7*b* formed in the drive shaft 7, an axial hole 7*a* formed in the drive shaft 7, and a passage 4*d* formed in the rear side block 4, and also communicates with one of the compression spaces 12, 12 through the passage 3*d* formed in the front side block 3. Consequently, when a compression chamber defined between two succesive vanes $\mathbf{14}_1$–$\mathbf{14}_5$ is on the suction stroke, part of refrigerant gas within the suction chamber 11 is drawn into the compression chamber 12 through the passage 4*d*, the axial passage 7*a*, the radial passage 7*b*, the front bearing chamber 3*c*, and the passage 3*d*, in the mentioned order, to lubricate the front bearing 8.

A rear bearing chamber 4*b* is formed in the rear side block 4 and accommodates the rear bearing 9. The rear bearing chamber 4*b* communicates with the rear oil sump 10*b* through a passage 4*c* formed in the rear side block 4 and a restriction passage 25. Thus, oil under discharge pressure Pd within the rear oil sump 10*b* is supplied into the rear bearing chamber 4*b* through the restriction passage 25 and the passage 4*c*, to lubricate the rear bearing 9.

A pair of back pressure compensation holes 29, 29 as back pressure compensation hole means are formed through the control element 27 at diametrically opposite locations such that when the control element 27 is in the partial capacity position, wherein the vane back pressure Pk is relatively low due to decreased discharge pressure Pd, the compensation holes 29 each communicate with each of the vane back pressure chamber $\mathbf{13}_1$–$\mathbf{13}_5$ to supply same with oil from the rear oil sump 10*b* to thereby compensate for a decrease in the vane back pressure Pk, whereas when the control element 27 is in the full capacity position, wherein the vane back pressure Pk is relatively high due to increased discharge pressure Pd, the holes 29 are each blocked by inner ends of the vanes $\mathbf{14}_1$–$\mathbf{14}_5$. The back pressure compensation holes 29, 29 communicate with the rear oil sump 10*b* through the rear bearing chamber 4*b*, the passage 4*c*, and the restriction passage 25.

The operation of the variable capacity vane compressor constructed as above will be explained below.

During operation of the compressor, refrigerant gas is supplied from the suction chamber 11 into each compression chamber on the suction stroke, which is defined between successive two of the vanes $14_1$–$14_5$, through the refrigerant inlet port 15 and the cut-out portion 28 of the control element 27. When the trailing vane (e.g. the vane $14_2$) passes the front end 28*a* of the cut-out portion 28, the compression chamber between the two successive vanes $14_1$ and $14_2$ is brought out of communication with the inlet port 15, to start the compression stroke.

When the control element 27 is positioned in the full capacity position shown in FIG. 2 for full capacity operation of the compressor, the suction stroke is effected while the trailing vane $14_2$ travels from a position $a_1$ to a position $a_2$. On the other hand, when the control element 27 is positioned in the partial capacity position shown in FIG. 3 for partial capacity operation of the compressor, the suction stroke is effected while the trailing vane $14_2$ travels from the position $a_1$ to a position $a_2'$. Therefore, the compression starting timing is retarded as the control element 27 rotates from the full capacity position to the partial capacity position, thereby continuously decreasing the delivery quantity or capacity of the compressor.

With rotation of the rotor 2, each vane $14_1$–$14_5$ is acted upon by a centrifugal force and the vane back pressure Pk within the vane back-pressure chamber $13_{10}$–$13_{50}$, which is introduced from the enlarged portions 22*a* of the annular groove 22, so that the vane $14_1 14_5$ has its tip kept in sliding contact with the inner peripheral surface 1*a* of the cam ring 1.

When each vane back-pressure chamber (e.g. the chamber $13_{10}$) is brought out of communication with the enlarged portion 22*a* of the annular groove 22 and then communicates with the oil supply holes 23, oil within the front oil sump 10*a* under the discharge pressure Pd is introduced into the vane back-pressure chamber $13_{10}$ through the restriction passage 24, the oil passage 3*b*, and the oil supply hole 23, in the mentioned order, thereby increasing the vane back pressure Pk within the vane back pressure chambers $13_{10}$–$13_{50}$ Therefore, the vanes $14_{1-5}$ are positively kept in sliding contact with the inner peripheral surface 1a of the cam ring 1 by the increased vane back pressure Pk together with the centrifugal force acting thereon.

Figure 7A:
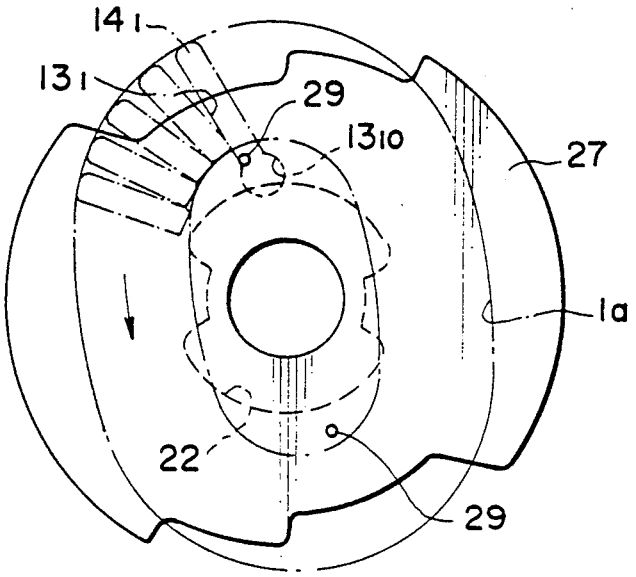
FIG. 7 (*a*) and (*b*) are views useful in explaining the relationship in position between a vane back pressure-introducing hole and a vane.
Figure 7B:
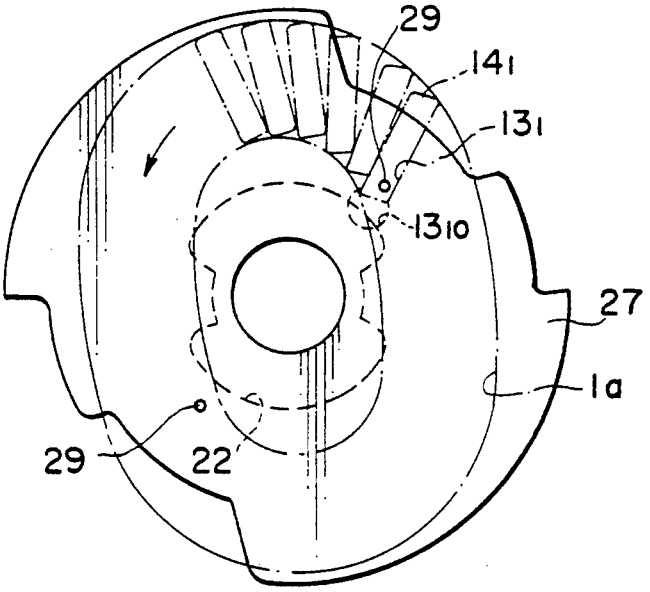
Figure 8:
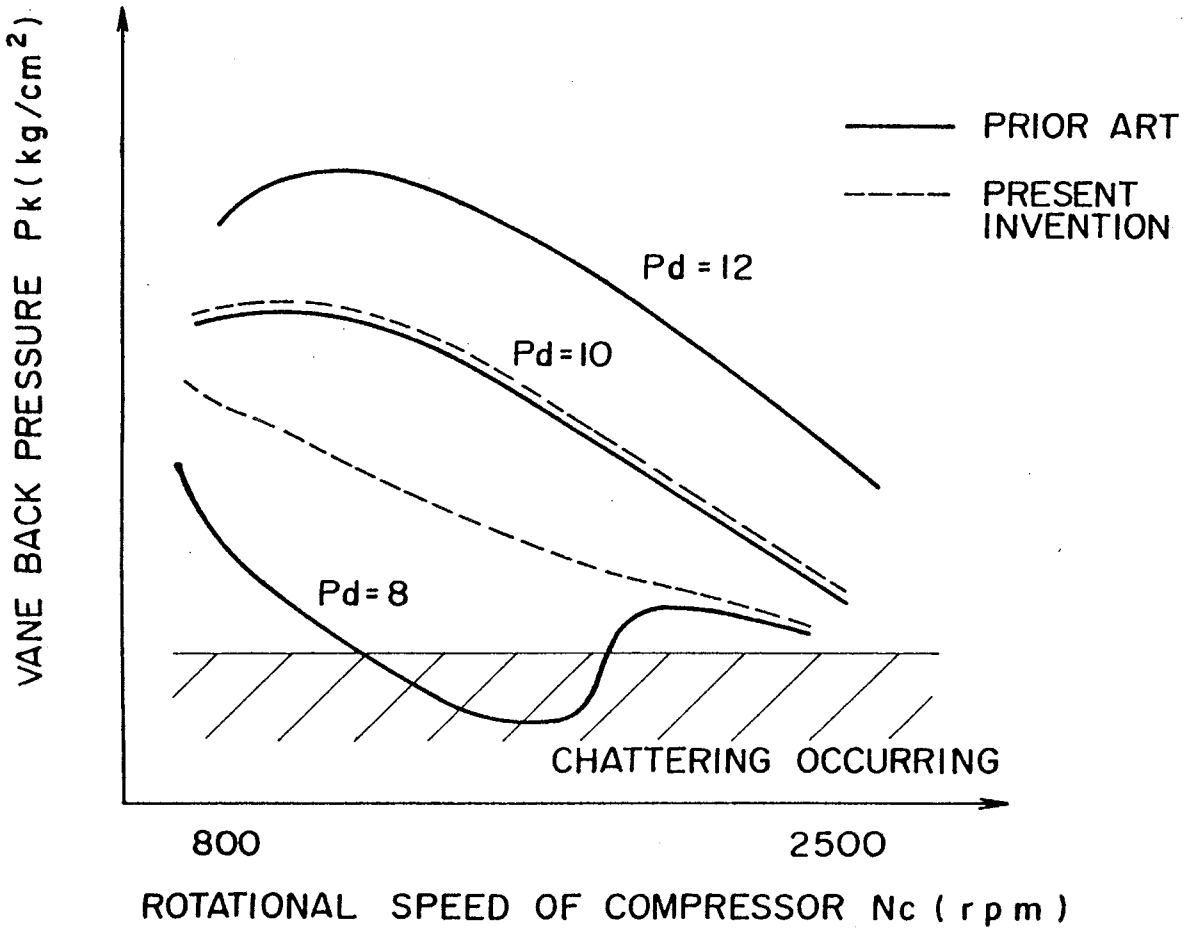
FIG. 8 is a graph showing the relationship between discharge pressure, rotational speed, and vane back pressure of the compressor.

When the compressor is brought into partial capacity operation, the back pressure compensation holes 29 each become positioned in a radially inward position relative to the vane, as shown in (a) of FIG. 7, as the control element 27 rotates into the partial capacity position, wherein the back pressure compensation hole 29 communicates with the vane back pressure chamber $13_{10}$–$13_{50}$, so that oil within the rear oil sump 10*b* is introduced into the vane back pressure chamber through the restriction passage 25, the oil passage 4*c*, the rear bearing chamber 4*b*, and the back pressure compensation hole 29. Thus, during the partial capacity operation oil is introduced into the vane back pressure chambers $13_{10}$–$13_{50}$ from the back pressure compensation holes 29, 29 so that the vane back pressure Pk is maintained at a required high level, as shown by the broken line corresponding to discharge pressure Pd = 8 kg/cm$^2$ in FIG. 8, whereby chattering of the vanes $14_1$–$14_5$ is prevented even when the rotor 2 is biased toward the front side block 3 to obstruct flow of oil through the clearance between the opposed end faces of the rotor 2 and the front side block 3 during the partial capacity operation.

On the other hand, as shown in FIG. 7 (*b*), when the compressor is in full capacity operation with the control element 27 positioned in the full capacity position, the back pressure compensation hole 29 is in a radially outward position relative to the vane $14_1$, and accordingly blocked by the vane $14_1$, so that oil within the rear oil sump 10*b* is inhibited from being introduced into the vane back pressure chambers. As a result, the vanes $14_1$–$14_5$ do not undergo excessive vane back pressure Pk and hence an excessive urging force acted thereon against the inner peripheral surface 1*a* of the cam ring 1, thereby avoiding excessive wear in the tips of the vanes $14_1$–$14_5$.

Although in the first embodiment described above, the oil supply holes 23 and the back pressure compensation holes 29 are both employed, only the latter may be employed with the former being omitted.

Further, each back pressure compensation hole 29 may have a circumferentially elongate opening instead of a single round opening as employed in the above described embodiment.

Figure 9:
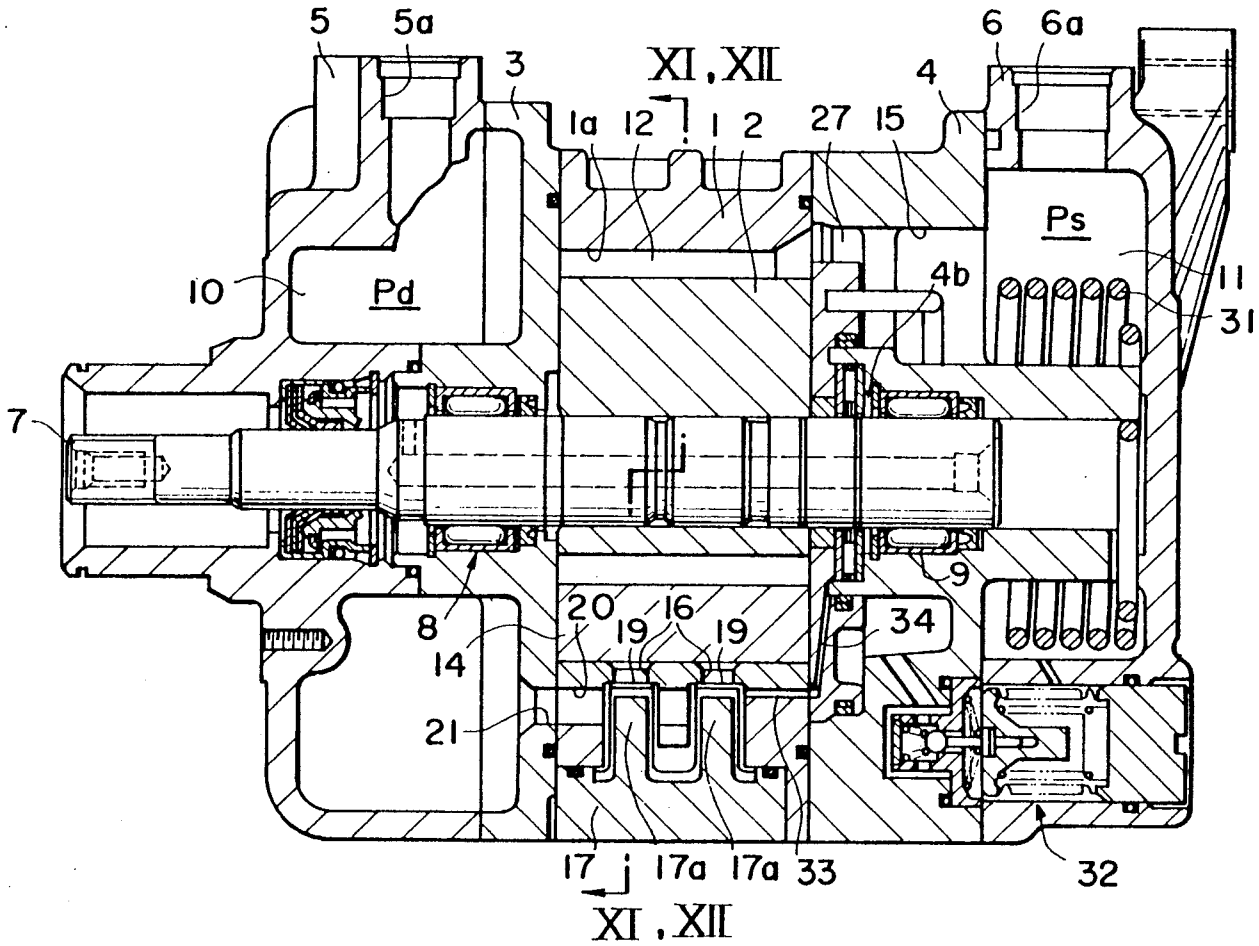
FIG. 9 is a longitudinal sectional view of a variable capacity vane compressor, according to a second embodiment of the invention.

FIG. 9 shows a variable capacity vane compressor according to a second embodiment of the invention.

Figure 10:
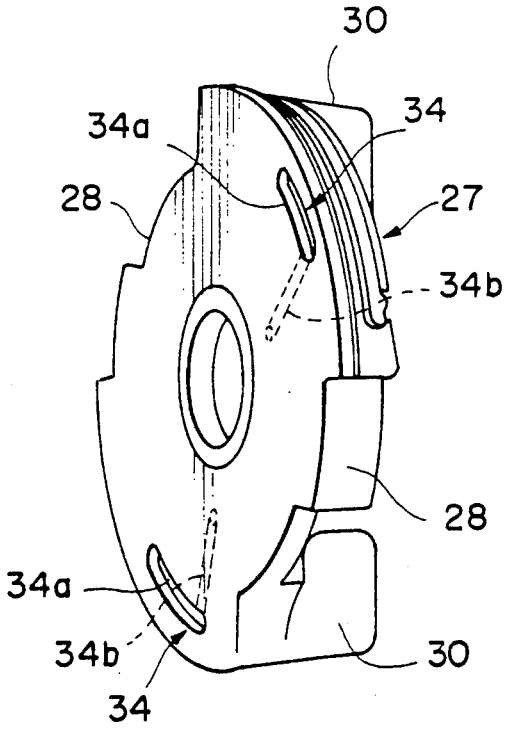
FIG. 10 is a perspective view of a control element of the compressor of FIG. 9.
Figure 11:
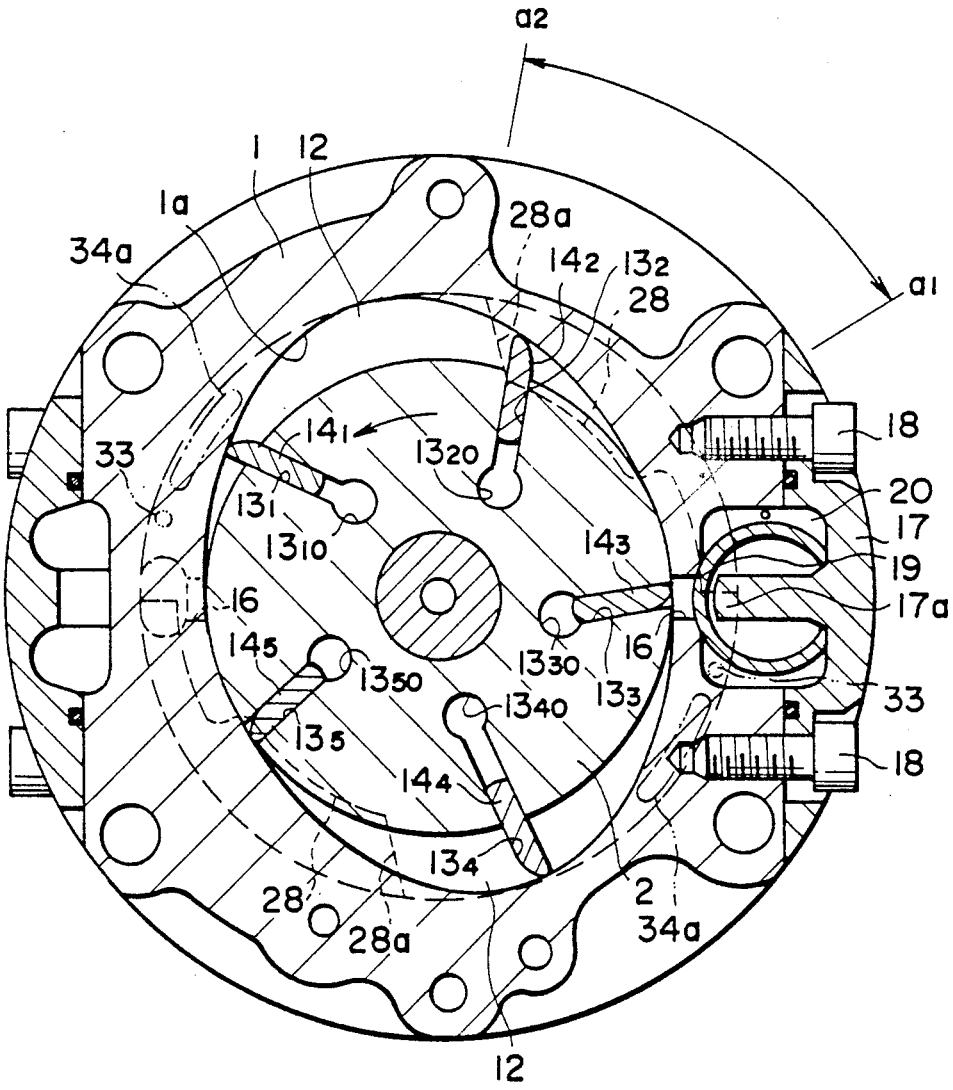
FIG. 11 is a transverse cross-sectional view taken along line XI—XI in FIG. 9, wherein the compressor is in full capacity operation.
Figure 12:
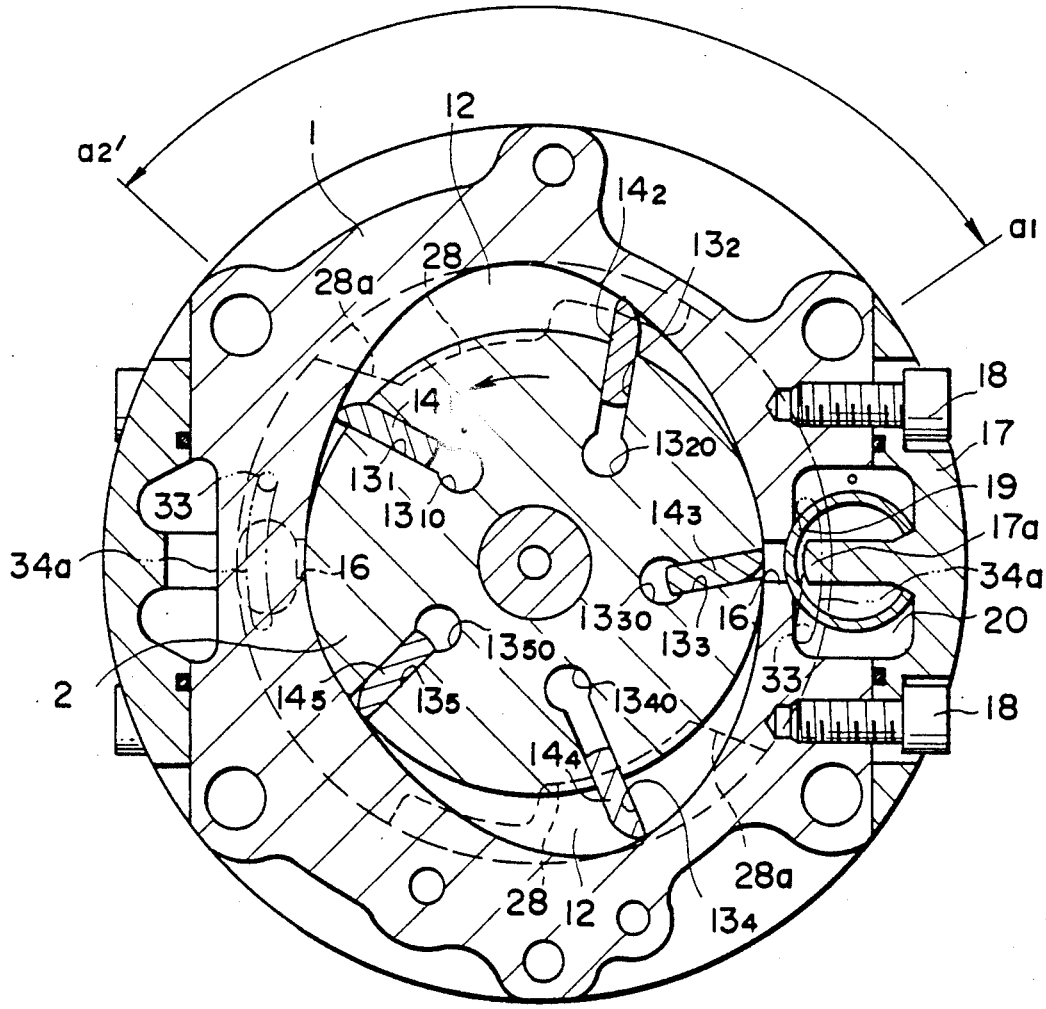
FIG. 12 is a view similar to FIG. 11, wherein the compressor is in partial capacity operation.

The second embodiment is distinguished from the first embodiment in that a restriction passage 33 is formed in the cam ring 1 in communication with the discharge pressure chamber 10 through the communication passages 20, 21, and a pair of pressure introducing holes 34 as back pressure compensation hole means are formed in the control element 27 at circumferentially opposite locations, in place of the back pressure compensation holes 29, 29. As shown in FIG. 10, the pressure introducing holes 34, 34 each comprise a circumferentially elongate or arcuate opening 34*a* formed by spot facing in the end face of the control element 27 facing the rotor 2, and a hole 34*b* extending radially obliquely from the arcuate opening 34*a* and opening in the end face of the control element 27 remote from the rotor 2 and opening into the rear bearing chamber 4*b*. The arcuate opening 34*a* of each pressure introducing hole 34 is so located relative to the restriction passage 33 that when the control element 27 is in the partial capacity position, the pressure introducing hole 34 communicates with the restriction passage 33 to permit the discharge pressure Pd to be introduced therethrough into the rear bearing chamber 4*b*, whereas when the control element 27 is in the full capacity position, the pressure introducing hole 34 is blocked by the opposed end face of the cam ring 1 to be disconnected from the restriction passage 33. With this arrangement of the pressure introducing hole 34, 34, when the compressor is in partial capacity operation, discharged refrigerant gas is introduced into each of the vane back pressure chambers $13_{10}$–$13_{50}$ through the restriction passage 33, the pressure introducing hole 34, the rear bearing chamber 4*b*, a clearance between the drive shaft 7 and the control element 27, and a clearance between the rotor 2 and the control element 27, in the mentioned order. Therefore, also the second embodiment can prevent chattering of the vanes $14_1$–$14_5$ during partial capacity operation of the compressor, as well as excessive wear in the tips of the vanes $14_1$–$14_5$ during full capacity operation of the compressor, similarly to the first embodiment.

What is claimed is:

1. In a variable capacity vane compressor including a cylinder, a rotor rotatably received within said cylinder, a plurality of vanes slidably fitted in respective vane slits formed in said rotor, vane back pressure chambers defined within said vane slits by respective ones of said vanes, a high pressure zone having high pressure created therein by said compressor, a control element rotatably arranged in said cylinder for varying the compression starting timing and hence the capacity of said compressor, the improvement comprising back pressure compensation hole means formed through said control element and communicating with said high pressure zone, said back pressure compensation hole means being communicatable with each of said vane back pressure chambers for introducing said high pressure within said high pressure zone into said each vane back pressure chamber when said control element is in a first position wherein the compression starting timing is retarded, and disconnectable from said each vane back pressure chamber for inhibiting said high pressure within said high pressure zone from being introduced into said each vane back pressure chamber when said control element is in a second position wherein the compression starting timing is advanced.

2. The compressor as claimed in claim 1, wherein said back pressure compensation hole means has one end thereof opening in one end face of said control element facing said rotor, said one end of said back pressure compensation hole means being disposed to be in a radially inward position relative to said vanes to communicate with said vane back pressure chambers when said control element is in said first position, and in a radially outward position relative to said vanes to be disconnected from said vane back pressure chambers when said control element is in said second position.

3. The compressor as claimed in claim 1, wherein said back pressure compensation hole means comprises a passage formed in said cylinder and communicating with said high pressure zone, and a hole formed in said control element and communicating with said vane back pressure chambers, said hole being disposed to communicate with said passage when said control element is in said first position, and disconnected from said passage when said control element is in said second position.

4. The compressor as claimed in claim 3, wherein said passage comprises a restriction passage.

5. The compressor as claimed in any of claims 1 to 3, including first and second side blocks forming part of said cylinder, and an annular groove formed in one end face of said first side block facing said rotor, said annular groove having at least one enlarged portion for communication with each of said vane back pressure chambers for introducing high pressure into said vane back pressure chamber while an associated one of said vanes is moving from a suction stroke-starting position to an intermediate position during a compression stroke thereof, said vane back pressure compensation hole means being arranged in said second side block.

6. The compressor as claimed in claim 5, further including at least one oil supply hole formed in said first side block and having one end thereof opening in said one end face of said first side block at a location other than said annular groove for introducing high pressure into said each vane back pressure chamber after said enlarged portion of said annular groove is disconnected from said each vane back pressure chamber and until said associated one of said vanes completes a delivery stroke thereof.

* * * * *